United States Patent [19]

Weber et al.

[11] Patent Number: 4,899,883

[45] Date of Patent: Feb. 13, 1990

[54] PACKAGE FOR AND METHOD OF PACKAGING POWDER AND OTHER FLUENT MATERIAL

[75] Inventors: Paul Weber; Michael A. Tannenbaum, both of Ivyland, Pa.

[73] Assignee: Delvco Industries, Inc., Ivyland, Pa.

[21] Appl. No.: 263,565

[22] Filed: Oct. 27, 1988

[51] Int. Cl.[4] ..... B65D 85/84

[52] U.S. Cl. ..... 206/484; 53/405; 53/468; 206/524.1

[58] Field of Search ..... 206/484, 524.1; 53/467, 53/468, 403, 405

[56] References Cited

U.S. PATENT DOCUMENTS

| | | | |
|---|---|---|---|
| 3,103,224 | 9/1963 | Dearling | 220/256 |
| 4,362,036 | 12/1982 | Shanklin | 220/256 |
| 4,520,940 | 6/1985 | Boyd et al. | 220/256 |
| 4,712,711 | 12/1987 | Geering et al. | 220/256 |

*Primary Examiner*—Joseph Man-Fu Moy

*Attorney, Agent, or Firm*—Panitch Schwarze Jacobs & Nadel

[57] ABSTRACT

A package and method of packaging for powder and other fluent material wherein a first covering is provided over a receptacle and affords access to the receptacle interior, and a second covering is applied over the first covering to effectively seal the contents in the receptacle.

7 Claims, 2 Drawing Sheets

PACKAGE FOR AND METHOD OF PACKAGING POWDER AND OTHER FLUENT MATERIAL

BACKGROUND OF THE INVENTION

For many years powder-like product has been packaged in receptacles with a paper covering which may be impaled to provide one or more holes for access to the powder, as by a powder puff.

This procedure has not been satisfactory, in that powder escapes during the packaging, being both a loss to the packager and reducing the provision of an easily sealed package.

SUMMARY OF THE INVENTION

Accordingly, it is an important object of the present invention to provide a novel package and method of packaging wherein powder-like material may be filled into or dispensed to separate receptacles with little or no escape of the material, so that sealing surfaces remain capable of adhesion for effective hermetic sealing.

Other objects of the present invention will become apparent upon reading the following specification and referring to the accompanying drawings, which form a material part of this disclosure.

The invention accordingly consists in the features of construction, combinations of elements, and arrangements of parts, which will be exemplified in the construction hereinafter described, and of which the scope will be indicated by the appended claims.

DESCRIPTION OF THE PREFERRED EMBODIMENT

Figure 1:
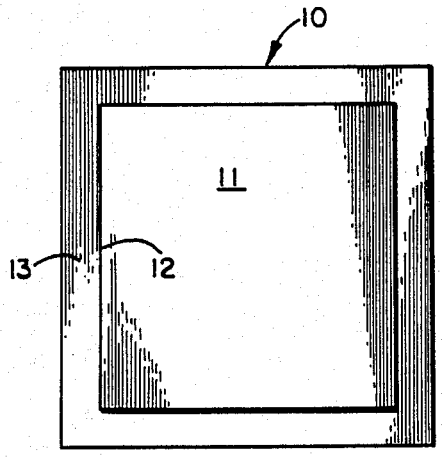
FIG. 1 is a top plan view showing an empty receptacle of the present package.
Figure 3:
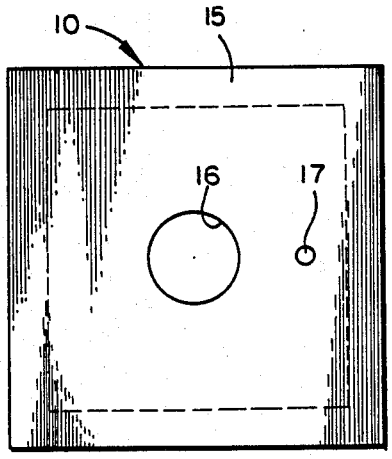
FIG. 3 is a top plan view showing the receptacle of FIGS. 1 and 2 with a covering of paper or like frangible sheet material.
Figure 2:
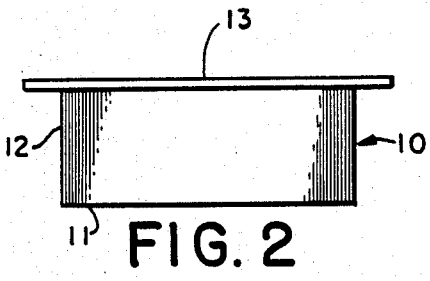
FIG. 2 is a side elevational view of the receptacle of FIG. 1.
Figure 4:
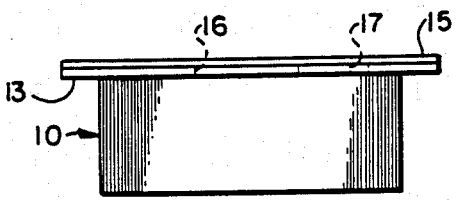
FIG. 4 is a side elevational view of the assembly of FIG. 3.

Referring now more particularly to the drawings, and specifically to FIGS. 1 and 2 thereof, a container or receptacle is there generally designated 10, and may be fabricated of plastic or other suitable material. The receptacle or container 10 may include a bottom wall 11, and a peripheral upstanding side wall 12. In the illustrated embodiment, the receptacle or container 10 is shown as generally rectangular or square, but may assume a variety of configurations, say circular, polygonal with arcuate sides, or otherwise, as desired. Further, the peripheral side wall 12 is seen to upstand from the bottom wall 11, entirely thereabout, to an upper extremity which is generally planar and parallel to the bottom wall. Outstanding circumferentially about the side wall 12 is a lip or flange 13 providing a surface for adhesive sealing, and effectively rigidifying the container.

The container or receptacle 10 is provided with an inner covering 15 parallel to and spaced over the bottom wall 11 and suitably secured, as by adhesive, to the upper surface of the flange 13. The covering 15 is of a frangible material for easy puncturing or tearing, such as paper, and includes a central material feed opening 16, communicating between the exterior and interior of the receptacle 10. The feed opening 16 is preferably located centrally of the receptacle 10, and an additional, smaller, vent opening 17 is provided in the covering sheet 15, but eccentrically thereof. The covering 15 may be thermosealed to the flange 13, or otherwise suitably secured.

Figure 5:
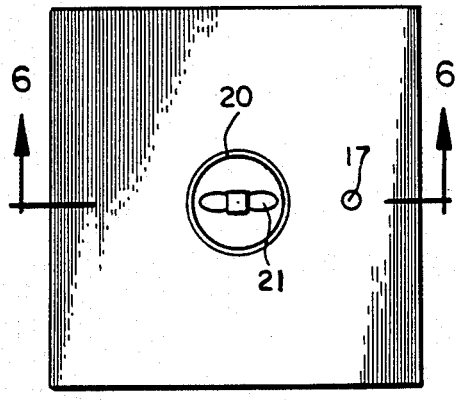
FIG. 5 is a top plan view of the assembly of FIGS. 3 and 4 with a feed conduit shown in position for feeding contents to the package.
Figure 7:
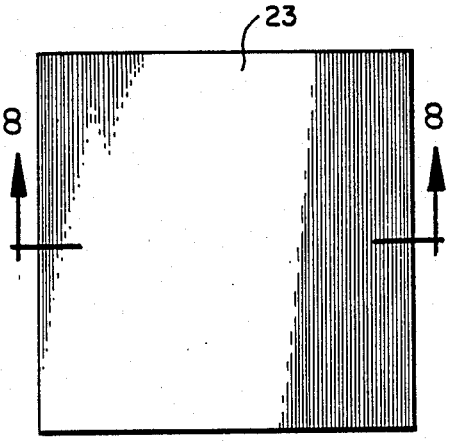
FIG. 7 is a top plan view of the instant package having an additional covering for effectively sealing the package.
Figure 6:
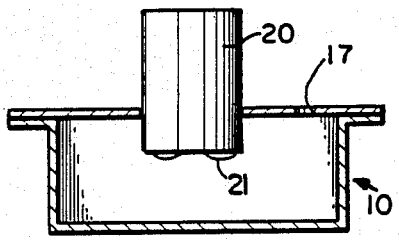
FIG. 6 is a sectional elevational view taken generally along the line 6—6 of FIG. 5.
Figure 8:
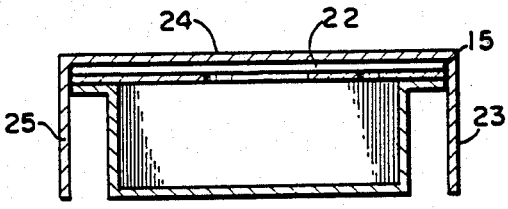
FIG. 8 is a sectional elevational view taken generally along the line 8—8 of FIG. 7.

A feed conduit 20 is shown in FIGS. 5 and 6 for feeding contents to the interior of receptacle 10. The feed conduit 20 may be a hose or pipe having a fan or pump for impelling the contents radially outwardly into the receptacle 10. The vent 17 may afford escape of air and entrained material from the receptacle through a vent tube to a separate chamber during feeding of the contents.

After filling of the receptacle 10, the feed conduit 20 and a vent conduit are removed, and a second covering sheet 22 is suitably adhesively sealed to the upper or outer surface of the inner covering sheet 15. More specifically, the outer covering 22 may have its margin adhesively secured to the margin of the inner covering 15, the latter being free of powder, dust and contents.

While the outer covering 22 may suffice as an exterior face for the package, it may be desired to provide an additional covering 23 having a top wall 24 overlaying the covering sheet 22 an a depending peripheral wall 25. However, the outer cover 23 is not essential for hermetic sealing or retaining contents in the receptacle, as in the prior art.

Figure 9:
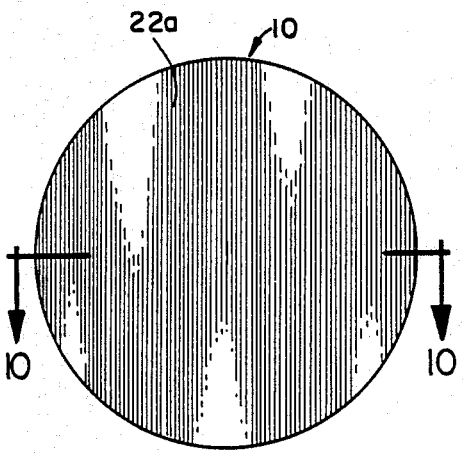
FIG. 9 is a top plan view showing a modified package of the present invention.
Figure 10:
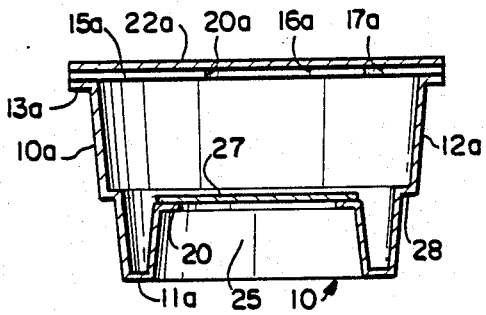
FIG. 10 is a sectional elevational view taken generally along the line 10—10 of FIG. 9.

Considering the embodiment of FIGS. 9 and 10, the container or receptacle **10*a* may include a bottom wall 11*a* from which upstands a peripheral side wall 12*a***.

The bottom wall **11*a* may be recessed upwardly, as at 25, and centrally cut out, as at 26. The central cut out 26 may be closed by a fragible or paper covering element 27 adhesively secured circumferentially about the bottom wall recess 26**.

If desired, the side wall **12*a* may be configured to provide a downwardly facing external, circumferential shoulder 28 which may serve to seat a base or support in the orientation of FIG. 10, and may seat a cover or cap when the container 10*a*** is inverted.

After the covering or sealing sheet 27 is adhesively secured or otherwise sealed to the bottom wall 25, the container **10*a* may be provided with an inner covering sheet 15*a* sealed to the lip or flange 13*a* and having filling and vent openings 16*a* and 17*a*** as in the first described embodiment.

Thus, the container **10*a* is adapted to be filled in the same manner as the container 10, through fill opening 16*a* while vent fluid is exhausted through vent opening 17*a*. The outer covering sheet 22*a* may be secured in sealed relation over the inner covering sheet 15*a*, and upon inversion of the container 10*a* the recessed bottom wall may provide a receiver, as for a powder puff. The inner cover 27 is impaled to afford communication with the powder or fluent material in the container 10***a*; and, the shoulder 28 may support a cover for the upwardly facing bottom wall recess 25.

From the foregoing it is seen that the present package and method of packaging are extremely simple, effectively resist loss of contents, greatly facilitate adhesive assembly, and otherwise fully accomplish their intended objects.

Although the present invention has been described in some detail by way of illustration and example for purposes of clarity of understanding, it is understood that certain changes and modifications may be made within the spirit of the invention.

What is claimed is:

1. A package for powder and other fluent material, said package comprising a receptacle for the fluent material including a bottom wall and a peripheral side wall upstanding from the bottom wall to a generally planar upper extremity, a first frangible covering spaced over said bottom wall and sealing engaging the planar upper extremity of said side wall, said first covering having a material feed opening for receiving and engaging a material feed conduit for the discharge of the fluent material to the interior of said receptacle and a separate vent opening for receiving and engaging a vent tube for the removal of air and entrained fluent material from the receptacle when the fluent material is discharged from the material feed conduit, and a second imperforate frangible covering generally the same size as the first covering and sealingly engaging said first covering to hermetically enclose the contents of said receptacle.

2. A package according to claim 1, in combination with an outer covering configured to slip over said second covering and receptacle without escape of said fluent material.

3. A package according to claim 1, in combination with a peripheral outstanding flange on said receptacle defining said upper extremity, said first covering being adhesively sealed in facing engagement with said flange entirely thereabout.

4. A package according to claim 1 wherein the material feed opening is centrally located and the vent opening is eccentrically located on the first covering.

5. A package according to claim 1 wherein the second covering is adhesively sealed to the periphery of the first covering.

6. A method of packaging a fluent material comprising providing a receptacle with a first frangible sealed cover having a material feed opening and a separate vent opening, inserting a material feed conduit into said feed opening to feed fluent material into said receptacle while concurrently inserting a vent tube into said vent opening for receiving air and entrained fluent material from the receptacle when fluent material is fed into said receptacle, and applying a second imperforate frangible covering over said first frangible covering to seal the contents in said receptacle.

7. A method of packaging according to claim 6, further characterized in locating said material feed opening centrally of said first covering, and feeding material into said receptacle and radially outwardly away from said opening to minimize the escape of material from said receptacle.

* * * * *